US006263809B1

(12) United States Patent
Wolters

(10) Patent No.: US 6,263,809 B1
(45) Date of Patent: Jul. 24, 2001

(54) HEIGHT-ADJUSTABLE SUPPORT FOR SUPPORTING A TABLE TOP

(75) Inventor: Johan Wolters, Lochem (NL)

(73) Assignee: Argo Office B.V., LZ Zeist (NL)

( * ) Notice: Subject to any disclaimer, the term of this patent is extended or adjusted under 35 U.S.C. 154(b) by 0 days.

(21) Appl. No.: 09/515,333

(22) Filed: Feb. 29, 2000

(30) Foreign Application Priority Data

Mar. 4, 1999 (NL) ..... 1011454

(51) Int. Cl.[7] ..... A47B 9/00
(52) U.S. Cl. ..... 108/147
(58) Field of Search ..... 108/147, 144.11, 108/147.19, 137, 139; 248/188.4, 188, 188.1, 188.5, 188.2

(56) References Cited

U.S. PATENT DOCUMENTS 5,447,099 * 9/1995 Adams et al. ..... 108/147
5,549,053 * 8/1996 Grout ..... 108/147
5,890,438 * 4/1999 Frankish ..... 108/147
6,131,870 * 10/2000 Tseng ..... 108/147 X
6,148,741 * 11/2000 Motta ..... 108/147 X

* cited by examiner

*Primary Examiner*—Jose V. Chen
(74) *Attorney, Agent, or Firm*—Foley & Lardner

(57) ABSTRACT

Assembly comprising two height-adjustable supports such as for a table top, the supports at their upper ends being mutually connected by a beam. The height-adjustment takes place in that a threaded rod is rotatably received in the upper part and extends into a nut, fitted in the lower part of the support. At its upper end, the threaded rod is connected to a bevel gear wheel, which is in engagement with a bevel gear wheel connected to a coupling rod, coupling the threaded rods of both supports to each other. The lower part is led across the upper part, and a screening plate extending around the circumference of the support is connected to the upper part, the screening plate running downwards and abutting the inner circumference of a tubular part connected to the lower part of the support.

8 Claims, 2 Drawing Sheets

HEIGHT-ADJUSTABLE SUPPORT FOR SUPPORTING A TABLE TOP

BACKGROUND OF THE INVENTION

The present invention relates to a height-adjustable support such as for supporting a table top, in which two supports can be coupled to one another at their upper ends by at least one beam and the height adjustment takes place by means of a threaded rod being rotatably but not axially movable received in the upper part of a support and extending into a nut mounted in the lower part of said support, said part being provided with a laterally extending base and being axially movable in relation to the upper part of the support, in which the threaded rod can be rotated manually or by motor and the threaded rod has its upper end provided with a bevel gear wheel that can engage with a bevel gear wheel connected to a horizontally extending coupling rod coupling the threaded rods of both supports.

Such an assembly of height-adjustable supports is known from U.S. Pat. No. 2,368,748. With this assembly, the lower part of a support is located partly within the upper part. This has the disadvantage, that it produces a less attractive whole, since the lower part is nearly always at some distance from the base of the lower part. Furthermore, there is a risk that an object can be underneath the bottom edge of the uper part. This object or the support itself may be damaged when lowering the support.

SUMMARY OF THE INVENTION

The object of the invention is to remove these difficulties and to that end provides for, that the lower part of a support is directed across its upper part and that the top end of a support is connected to a screening plate extending around the circumference of the support, said screening plate extending downwards and engaging the circumference of the lower part of the support, the lower part of the support being provided with a tubular portion in which the screening plate is located.

Since the screening plate can have a minimal thickness, only a hardly visible transition between both parts of the support will be in sight, so that an esthetic unity is achieved.

In order to prevent the lower edge of the screening plate from contacting an object abutting the lower part of the support, on downward movement of the support, the lower part of the support is provided with a tubular portion, in which the screening plate is located.

Obviously, the wall of the tubular portion will only be of a minimal thickness, so that in this case too, there will be a hardly visible transition between both parts.

A simple connection of the screening plate to the upper part of a support can be achieved, in that said part is provided with at least one horizontally extending pin which can be received in a bore in the screening plate.

Now the upper part of a support will at one side be connected to the horizontal beam, so that at that side, the screening plate will have to have a shape adapted to it. To that end, it can be provided for, that the screening plate consists of two part, namely a first part which is substantially at that side of the support where a beam can be connected to the support, and a second part which is situated at the other side.

Now, at its upper end, the one plate can be provided with a recess for receiving the beam therein, while the other plate can extend up to the top edge of the support.

It is possible to couple both parts of the screening plate at the longitudinal edges, such as by mutually engaging edges.

Manufacuring two separate parts of the screening plate is easier than manufacturing it as a whole.

Further, above-mentioned U.S. Pat. No. 2,368,748 has the disadvantage, that the distance between both supports is fixed. However, it is often desirable that this distance can be adjusted to the desired length of a table top to be mounted on the supports.

According to the invention, it is provided for, that the beam connecting both supports comprises two parts movable in relation to each other, and that the coupling rod bearing the two bevel gear wheel cooperating with the bevel gear wheels of the threaded rods in the supports, also has two parts telescopically slidable in relation to each other.

The distance between both supports can then be varied in a simple way.

In order to be able to carry out mounting assembly of the coupling rod in a simple way, it can be provided for, that the coupling rod is axially slidable within the bevel gear wheel positioned on it, said bevel gear wheel being rotatably mounted in the support so that it is always in engagement with the bevel gear wheel of the threaded rod located in the support, the coupling rod being pressed into the bevel gear wheel through a spring.

When mounting the coupling rod, the relevant part thereof can be pushed away from the support against the force of said spring and be aligned with the bevel gear wheel. After that, the coupling rod can be slid into the bevel gear wheel.

Further, the bevel gear wheel situated on the coupling rod can be mounted at the side of the support where the coupling rod is located, as well as at the other side thereof. In this way, it is achieved, that the bevel gear wheels at the ends of the threaded rods situated within the supports are rotated in the same direction.

The invention is further explained by way of an embodiment shown in the drawing.

Figure 1:
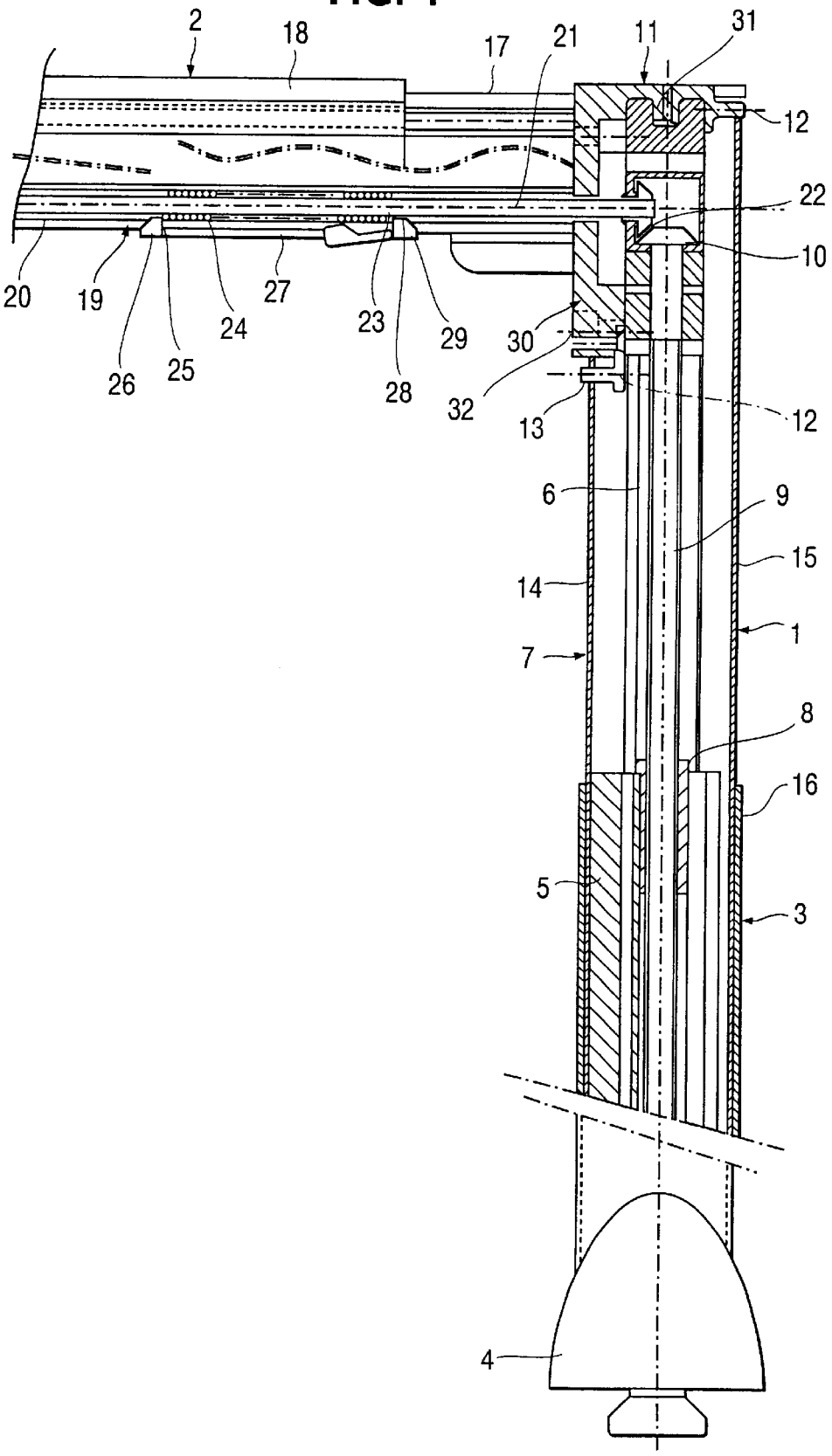
FIG. 1 shows a vertical section and partial view across a support and a part of the beam connected to it.
Figure 2:
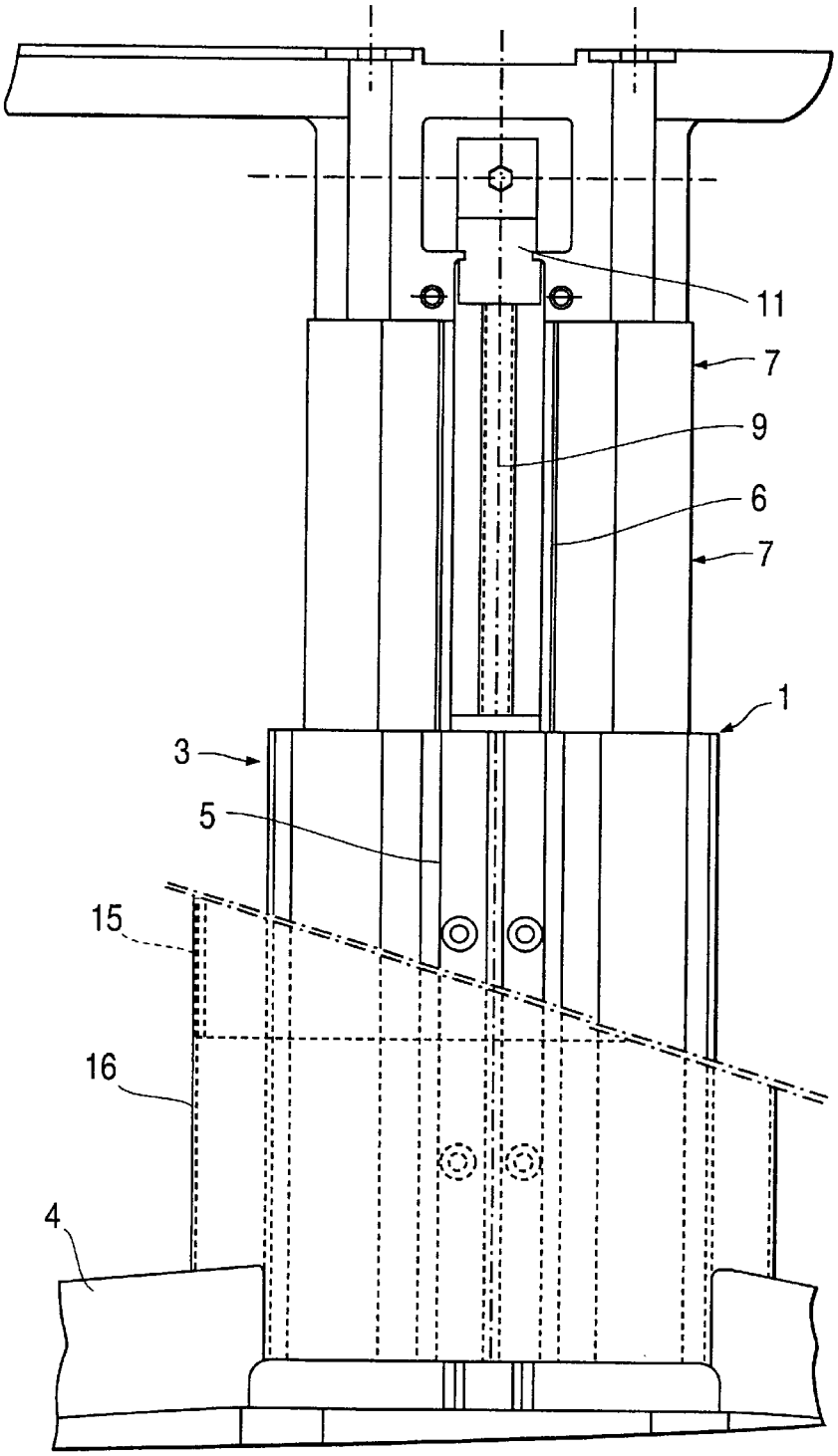
FIG. 2 shows a side view of the support of FIG. 1, in which certain parts have been omitted for the sake of clarity.

DETAILED DESCRIPTION OF THE PREFERRED EMBODIMENT.

Through a beam 2, the support 1 illustrated in the drawing is connected to another support (not illustrated), so that a table top (not illustrated either) can be mounted on both supports and the beam.

The support 1 comprises a lower part 3 provided with a base 4 on which one or more uprights 5 have been fastened in order to form a guide for a portion 6 of the upper part 7 of the support 1. This part 7 is only vertically movable in relation to the part 3. For this movement, a nut 8 is mounted in the support 1 in such a way, that it bears on the top edge of an upright 5 and is not rotatable. The threaded rod 9 is rotatable in the nut 8. The threaded rod 9 is rotatably, yet axially not slidably received in the upper part 7 of the support 1 and has its upper end provided with a bevel gear wheel 10. The bevel gear wheel 10 is rotatably, yet axially not movable, received in a connecting block 11 being connected to, or part of, the part 6 of the upper part 7 of the support 1.

The connecting block 11 is provided with two pins 12 being received in openings 13 in screening plates 14 and 15, which can be coupled to each other at their longitudinal edges in a way not further indicated. The lower ends of the plates 14 and 15 are received within a tubular part 16 which is connected to the base 4.

The connecting block 11 also serves for connecting, by means of bolts not further indicated, the upper part 7 of the support 1 to the part 17 of the beam 2, which part 17 is slidably mounted in the part 18 of the beam 2. The part 18 is connected to a connecting block of the other support not illustrated.

The coupling rod 19 is rotatably mounted in the beam 2. The coupling rod 19 comprises a tubular part 20 and a rod-shaped part 21 being slidable, yet not rotatable therein. Part 21 is slidably, yet not rotatably received in a bevel gear wheel 22, which is in engagement with bevel gear wheel 10. Bevel gear wheel 22 is rotatably supported in the connecting block 11.

In order to enable easy mounting of the coupling rod 19, a traverse pin 23 is arranged in the rod 21, said traverse pin being contacted by the spring 24 having its other side abutting a bush 25 loosely arranged on the rod and provided with a lip 26 projecting outwards through a slot 27 arranged in the part 17 of the beam 2. The traverse pin 23 is abutted by a ring 28 being provided with a lip 29 likewise projecting outwards through said slot 27. The spring 24 forces the lips 26 and 29 against the ends of the slot 27. Mounting and dismounting the coupling rod 19 only requires pressing the pin 23, and rod 21 with it, sufficiently far into the tube 20 with the help of lip 29, in order to release rod 21 from connecting block 11. After releasing the lip 29, the rod 21 can be slid into the bevel gear wheel 22.

Rod 19 can be rotated in the known way with the help of a crank or by means of an electric motor for height-adjustment of the supports.

As illustrated in FIG. 1, the bevel gear wheel 22 can e.g. be mounted in a housing which can be slid into a recess in connecting block 11. The housing can then easily be brought into another position, so that the bevel gear wheel 22 will then be located at the right side of the bevel gear wheel 10. Obviously, the rod 21 will have to be designed for that. Also, the housing can be made in such a way, that the axis of a further bevel gear wheel mounted in it encloses an angle of e.g. 45° with the prolongation of the axis of rod 21. A third support can then be connected to the right side of the support illustrated in FIG. 1 and be operated simultaneously with the other supports.

A coupling piece 30 having a part 31 bent at a right angle grasp over the top edge and which can be secured to the support by bolts 32 can be employed for connecting the beam 2 to a support 1.

All these possibilities will, however, be obvious to an expert and need no further explanation. In connection with that, it can be stated, that only one possible embodiment has been illustrated in the drawings and described above and that many changes can be made without leaving the inventive idea, as it is indicated in the appended claims.

What is claimed is:

1. Assembly of height adjustable supports for supporting a table top, in which two supports can be coupled to one another at their upper ends by at least one beam and the height adjustment takes place by means of a threaded rod being rotatably but not axially movable received in the upper part of a support and extending into a nut mounted in the lower part of said support, said part being provided with a laterally extending base and being axially movable in relation to the upper part of the support, in which the threaded rod can be rotated manually or by motor and the threaded rod has its upper end provided with a bevel gear wheel that can engage with a bevel gear wheel connected to a horizontally extending coupling rod coupling the threaded rods of both supports, wherein the lower part of a support is directed across its upper part and that the top end of a support is connected to a screening plate extending around the circumstance of the support, said screening plate extending downwards and engaging the circumference of the lower part of the support, the lower part of the support being provided with a tubular portion in which the screening plate is located, wherein the beam connecting both supports to each other, comprises two parts telescopically slidable in relation to each other, and wherein the coupling rod, carrying the two bevel gear wheels cooperating with the bevel gear wheels of the threaded rods in the supports, likewise has two parts telescopically slidable in relation to each other.

2. Assembly according to claim 1, wherein the upper part of a support is provided with at least one horizontally extending pin which can be received in a bore in the screening plate.

3. Assembly according to claim 1, wherein the screening plate comprises two parts, namely a first part being substantially at the side of the support where a beam can be connected to the support and a second part being situated at the other side.

4. Assembly according to claim 3, wherein both parts of the screening plate are coupled to one another at the longitudinal edges, such as by mutually engaging edges.

5. Assembly according to claim 1, wherein the coupling rod is axially slidable within the bevel gear wheel positioned on it, said bevel gear wheel being rotatably mounted in the support so that it always engages the bevel gear wheel of the threaded rod located in the support, in which the coupling rod is forced into the bevel gear wheel by means of a spring.

6. Assembly according to claim 1, wherein the nut located in a support is provided with a collar bearing on the top edge of the lower part of the support and cannot be rotated in it.

7. Assembly according to claim 1, wherein a coupling piece having a part bent at a right angle grasp over the top edge of the support is employed for connecting the beam to a support.

8. Assembly of height adjustable supports for supporting a table top, in which two supports can be coupled to one another at their upper ends by at least one beam and the height adjustment takes place by means of a threaded rod being rotatably but not axially movable received in the upper part of a support and extending into a nut mounted in the lower part of said support, said part being provided with a laterally extending base and being axially movable in relation to the upper part of the support, in which the threaded rod can be rotated manually or by motor and the threaded rod has its upper end provided with a bevel gear wheel that can engage with a bevel gear wheel connected to a horizontally extending coupling rod coupling the threaded rods of both supports, wherein the lower part of a support is directed across its upper part and that the top end of a support is connected to a screening plate extending around the circumstance of the support, said screening plate extending downwards and engaging the circumference of the lower part of the support, the lower part of the support being provided with a tubular portion in which the screening plate is located, wherein the coupling rod is axially slidable within the bevel gear wheel positioned on it, said bevel gear wheel being rotatably mounted in the support so that it always engages the bevel gear wheel of the threaded rod located in the support, in which the coupling rod is forced into the bevel gear wheel by means of a spring.

* * * * *